United States Patent [19]

Schmitt

[11] 3,943,480

[45] Mar. 9, 1976

[54] THERMOSTAT

[75] Inventor: Donald J. Schmitt, Mansfield, Ohio

[73] Assignee: Therm-O-Disc Incorporated, Mansfield, Ohio

[22] Filed: Dec. 18, 1974

[21] Appl. No.: 533,925

[52] U.S. Cl. ..... 337/371; 337/354

[51] Int. Cl.[2] ..... H01H 37/52

[58] Field of Search ..... 337/38, 41–44, 337/46, 63, 335, 343, 346–349, 337, 354, 370, 371, 372, 329, 26, 137, 399; 200/83 Y

[56] References Cited

UNITED STATES PATENTS

| | | | |
|---|---|---|---|
| 2,925,483 | 2/1960 | Wells | 337/370 X |
| 3,500,277 | 3/1970 | Nardulli | 337/354 |
| 3,852,698 | 12/1974 | Schmitt et al. | 337/348 |
| 3,878,499 | 4/1975 | Concin | 337/354 |

*Primary Examiner*—J. D. Miller
*Assistant Examiner*—Fred E. Bell
*Attorney, Agent, or Firm*—McNenny, Farrington, Pearne & Gordon

[57] ABSTRACT

A multiple bimetallic snap disc thermostat is disclosed in which two series connected switch mechanisms are respectively operated by two concentric bimetal snap discs having the same diameter. One snap disc is thermally automatic in operation to open and close its associated switch upon reaching its calibration temperatures. The outer disc is a one-shot disc which does not automatically reset and cannot be manually reset after operation. The two discs are mounted in a single, disc retaining cup, and are spaced by a ring positioned between their peripheries. This allows said discs to be formed of the same size and provides easy mounting. A single fixed contact member provides the fixed contact for both switches. The contacts of the switch associated with the automatic disc are capable of repeated operation whereas the contacts of the switch associated with the one-shot disc are not structured for repeated cycling.

28 Claims, 5 Drawing Figures

Fig. 1
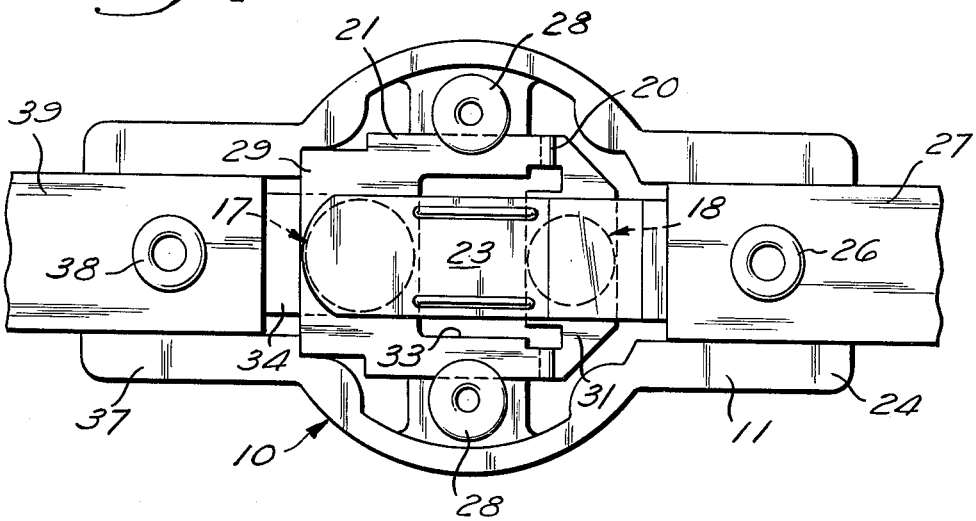
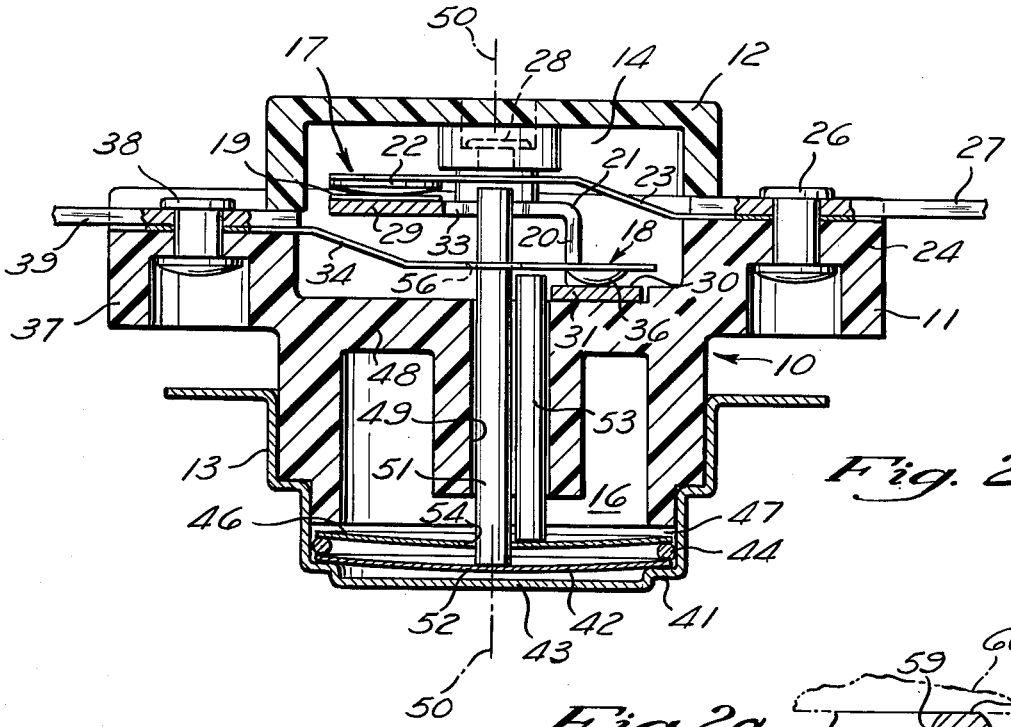
Fig. 2
Fig. 2a
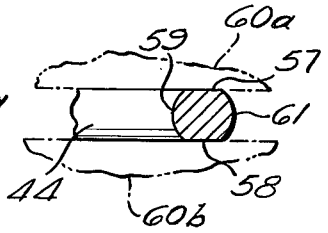
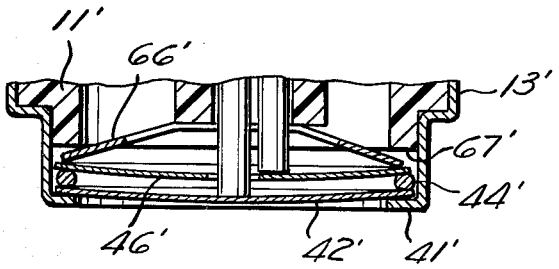
Fig. 3
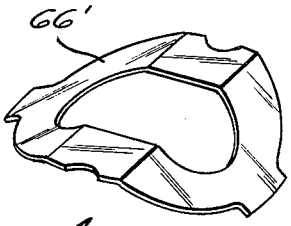
Fig. 4

THERMOSTAT

BACKGROUND OF THE INVENTION

This invention relates generally to bimetallic snap disc operated thermostats and more particularly to a novel and improved thermostat combining two bimetal snap discs, each of which is arranged to operate an associated one of two separate switches.

PRIOR ART

It is known to combine in a single device two bimetal snap discs which operate associated switching mechanisms. Examples of such devices are illustrated in the U.S. Pat. Nos. 2,207,422 dated July 9, 1941; 2,471,924 dated May 31, 1949; 3,493,911 dated Feb. 3, 1970; 3,500,277 dated Mar. 10, 1970, and the British Patent No. 1,214,252 dated Dec. 2, 1970. Such a device is also illustrated in the pending applications for U.S. Pat., Ser. No. 381,914 filed July 23, 1973, and Ser. No. 406,539 filed Oct. 15, 1973 (assigned to the assignee of the present invention). In such devices, the two snap discs are normally formed to provide different calibration or operating temperatures so that the associated switches are operated at different but predetermined temperatures. Some of such devices are not thermostats, but are relays employing heater means to operate the snap discs.

The thermostat devices described in some of such applications and patents can be used in appliances, in which a first appliance function is controlled at one temperature and a second appliance function is controlled at a different temperature. Also in appliances, operation of one disc is sometimes used for the normal control of an appliance function and the other disc operates as a high limit to prevent overtemperature or the like.

Insofar as I am aware, however, such devices have never combined in a single mechanism, one disc which automatically opens and closes its associated switch and the other disc does not automatically reset and cannot be manually reset after operation.

The U.S. Pat. No. 3,715,697 dated Feb. 6, 1973, and the copending application, Ser. No. 409,254 filed Oct. 24, 1973, both relate to a single disc "one-shot" device which cannot be manually reset in use. This patent and application are also assigned to the assignee of the present invention.

SUMMARY OF THE INVENTION

There are a number of aspects to this invention. In accordance with one aspect of this invention, a multiple disc device is provided in which a first disc is thermally automatic in that it snaps back and forth thermally to open and close its associated switch, and the second disc is non-automatic so that it does not thermally reset in use. In the preferred form illustrated the second disc cannot be reset, and such disc and its associated switch functions as a thermal fuse, or one-shot device, which must be replaced after operation. Such device is required in some installations as a positive limit control to prevent recycling of the defective system under hazardous conditions.

In the illustrated embodiments, the two switches are connected in series and are constructed for economy consistent with reliability. The switch, which is automatically recycled, is provided with contacts which are capable of repeated opening and closing. However, the switch, which is operated only once, is constructed with low-cost contacts, since the ability to recycle is not required. Further, a novel and improved composite switch structure makes for simple fabrication and assembly.

In accordance with another aspect of this invention, a novel and improved multiple disc device is provided, in which two center operating discs are concentric and are properly positioned by an improved, low-cost, reliable structure. In the illustrated embodiment, a simple spacer ring is positioned between the discs at their periphery. Such ring provides both proper location and a heat conductive path to the inner disc. In a modified form, spring means are provided to insure that good heat conducting contact is provided to maximize sensitivity and to insure that the operation of one disc does not produce undesired bounce or the like in the contacts associated with the other disc. In accordance with the preferred embodiment, the ring is flattened and dimensioned by deforming the ring materials from its original round section to an oval section having opposed flats.

It should be understood that although the illustrated embodiments of this invention incorporate all of the various aspects of the invention, some of the aspects can be used independently of others. For example, the preferred mounting of the disc has utility in devices which do not employ the one-shot feature. Also, the combined automatic and one-shot mechanism can be incorporated in devices having different mounting or support structures for the discs.

These aspects of the invention along with others are discussed in the following specification.

BRIEF DESCRIPTION OF THE DRAWINGS

FIG. 1 is a plan view with parts removed for purposes of clarity illustrating one preferred form of this invention.

FIG. 2 is a side elevation partially in cross section illustrating the structural detail of the thermostat of FIG. 1.

FIG. 2*a* is an enlarged fragmentary section of the preferred spacer ring.

FIG. 3 is an enlarged fragmentary section illustrating a modified form of disc mounting structure in which a spring urges the discs and spacer toward the support shoulder in the disc cap; and FIG. 4 is a perspective view of the spring provided in the embodiment of FIG. 3.

DETAILED DESCRIPTION OF THE DRAWINGS

Referring to the drawings, the illustrated device provides a body assembly 10 including a main body member 11, a cover member 12 and a disc retaining cup 13. The members 11 and 12 are preferably molded from plastic, such as a phenolic resin and the retainer cup 13 is preferably drawn from sheet metal. The two body members 11 and 12 cooperate to define an enclosed switch chamber 14 and the body member 11 cooperates with a disc retaining cup 13 to define and enclose the disc chamber 16. A pair of switch mechanisms 17 and 18 are mounted within the switch chamber 14. The switch mechanism 17 includes a fixed contact 19, provided at one end of the fixed contact element 21, and a movable contact 22 supported at the free end of a movable contact support arm 23. The movable support arm 23 is mounted on a terminal projection portion 24 of the main body member 11, by a rivet 26 which also functions to secure the associated terminal 27 in the electrical contact therewith.

The fixed contact member 21 is mounted on the main body element 11 by a pair of rivets 28, best illustrated in FIG. 1, which also function to secure the cover member 12 to the main body member 11. The contact element 21 is formed with a step at 20 to provide an upper laterally projecting section 29, and a lower laterally projecting section 31, as best illustrated in FIG. 2. The element 21 is also cut out at 33, as best illustrated in FIG. 1, to provide the clearance for the movable contact arm 34 of the second switch mechanism 18.

The second switch mechanism 18 includes a movable contact projection 36 formed at the free end of the contact support arm 34. The projection 36 is engageable with the upper surface 30 of the lateral portion 31, which functions as the stationary contact of the switch mechanism 18.

The switch 17 must be capable of repeated cycling so contacts 19 and 22 are provided with substantial quantities of contacts material. The contact 19 may be formed, for example, with a relatively thick layer of silver, which is positioned on the fixed contact element 21 or may be inlaid therein. On the other hand, the switch 18 need not be capable of repeated cycling so its contacts are preferably formed with much thinner surfaces of silver or the like, which may be, for example, plated on the respective supports.

Here again, the movable support arm 34 is secured and mounted on a terminal projection 37 formed on the body member 11 by a rivet 38, which also mounts and connects the associated terminal 39. When both switch mechanisms are closed, as illustrated in FIG. 2, the terminals 39 and 27 are electrically connected. If either of the two series connected switch mechanisms 17 or 18 is opened, the electrical connection between the two terminals is broken. In the illustrated embodiment only two terminals are required, however if the series connection of the switch is not desired an external terminal portion may be provided on the contact element 21.

The disc retaining cup 13 is provided with a peripheral shoulder 41 against which is seated the periphery of a first bimetal snap disc 42. In the illustrated embodiment, the disc retainer is closed by an end wall 43, which is stepped down from the shoulder 41 to provide clearance for the disc 42.

Positioned against the periphery of the disc 42 on the side opposite from the shoulder 41 is a loose spacer ring 44, preferably formed of wire or the like, in the manner described below. A second bimetal snap disc 46 is positioned at its periphery against the side of the ring 44, remote from the disc 42. The ring provides a simple, but accurate structure for mounting the inner disc 46 and permits the use of discs which are the same diameter. The wall 41*a* laterally locates the two discs 42 and 46 as well as the ring 44. Clearance 47 is provided between the side of the inner disc 46 and the end of the main body member 11.

The main body member 11 is provided with a central wall 48 with an 8-shaped opening 49 extending therethrough. The opening 49 is positioned so that one section of the "8" is coaxial with the center axis 50 of the discs and the entire device and the other portion is offset therefrom, in a direction toward the contacts of the second switch mechanism 18.

A first bumper 51 extends along the axis 50 of the disc 42 through an opening 54 in the disc 46 and an opening 56 in the arm 34 from the disc 42 to a position immediately below the movable contact arm 23. The bumper is sized to provide clearance so that the switch mechanism 17 will not be operated until the central portion 52 of the disc 42 is in full snap movement. By properly sizing the bumper 51, the operation of the first switch mechanism 17 occurs with snap action on both opening and closing.

A second bumper 53 is positioned in the other section of the opening 49 and engages the inner disc 46, immediately adjacent to the center opening 54 thereof. The upper end of the bumper 53 is positioned to engage the movable contact arm 34, adjacent to the contact 36, for operation of the second switch 18, in response to the snap movement of the disc 46. Here again, the bumper 53 is sized to provide the proper amount of clearance to insure that the second switch mechanism 18 is operated during the snap movement of the inner disc 46. It should be recognized that the clearance 47, at the periphery of the disc 46 or the clearance between the bumper 51 and 53 and their associated support arms 23 and 34 will exist as illustrated in FIG. 2, only if the device is positioned as illustrated in FIG. 2, so that gravity will maintain the various parts in such illustrated position. The device, however, can be operated in other positions, since it is not normally significant whether or not the clearances exist in the exact manner illustrated.

The ring 44 is illustrated in enlarged section in FIG. 2a and has a shape providing opposite flats 57 and 58 and curved intermediate sections 59 and 61. This shape is provided by deforming a round cross section wire ring between two flat platens 60*a* and 60*b* (illustrated in phantom). The two platens are pressed together to the required dimension between the two flat sections 57 and 58, to properly dimension the thickness of the ring. This operation also functions to flatten the ring and insure that it is not wavy and does not affect the operation of the discs in an adverse manner. With this simple process of deforming a round section wire to the shape illustrated in FIG. 2*a*, precise dimensioning and flattening of the ring is achieved.

In the illustrated embodiment, the disc 42 is formed for automatic operation. The form of the disc and the disc material is selected so that it snaps from the position of FIG. 2 upwardly to its operated position upon reaching a first predetermined temperature and snaps back to the illustrated position upon reaching a second predetermined temperature, both of which are normally encountered in the installed environment of the device. For example, the first predetermined temperature might be 110°F and the second predetermined temperature might be 90°F. In such an instance, the first switch mechanism 17 would snap open when the disc 42 reaches 110°F and would snap closed when the disc 42 returns to a 90°F temperature.

The inner disc 46, however, is formed for one-shot operation. In this instance the material used to form the disc and the disc form is arranged so that the disc snaps from the position illustrated in FIG. 2 to the operated position upon reaching a first predetermined temperature which can be encountered in the environment of the installed device, but cannot thermally snap back to the initial position illustrated in FIG. 2. This can be accomplished, for example, by forming the disc so that a second thermally operating calibration temperature is a temperature not encountered in the environment of the installed device. For example, the second calibration temperature of the disc could be at sub-zero temperatures not encountered, while the first operating temperature might be, for example, 250°F.

Such a non-automatic disc 46 has a wide differential temperature and, therefore, has greater chord height *h* than the disc 42. Since the stroke of the snap movement is a function of chord height, such disc snaps to a greater distance than the disc 42. No attempt has been made to illustrate the difference in size of chord heights of the two discs because the difference, though significant, is small in physical dimensions.

It is advantageous to position the non-automatic disc as the inner disc when its chord height is greater than the chord height of the outer automatic disc. This is because the position of the inner disc is affected by a greater number of manufacturing tolerances. The outer disc position is affected only by the tolerance of the position of the shoulder 41 with respect to the arm 23. However, the position of the inner disc 46 is affected by such tolerance and, in addition, the tolerance of the disc 42 and the ring 44. However, the greater amount of manufacturing tolerances encountered in the positioning of the inner disc is compensated for to a considerable extent by the greater chord height of such inner disc when compared to the chord height of the outer disc.

Another type of disc providing one-shot characteristics may be manufactured as disclosed in the copending application, Ser. No. 378,256 filed July 11, 1973, assigned to the assignee of the present invention. In such instances, a one-shot disc manufactured in accordance with this application does not necessarily have a greater chord height than a typical automatic disc. In such instances, the advantage mentioned above with respect to inner positioning the one-shot disc is not necessarily obtained.

It is generally preferred to provide the one-shot disc as the inner disc in devices where the operating sensitivity requirements are not as great as such requirement for the automatic disc. However, sensitivity of the inner disc is achieved because of the peripheral contact of the disc 46 with the metallic ring 44 and the disc retaining cup 13, both of which provide a heat-conducting flow path between the environment and the inner disc 46.

It is recognized that when the device of FIG. 2 is mounted in a position in which gravity does not maintain contact between the inner disc 46 and the shoulder 41 at all times, the sensitivity of the inner disc 46 will not be as great. In such instances, it may be desirable to utilize the modified form of this invention illustrated in FIG. 3. In such modified form, similar reference numerals are used for similar parts but a prime (′) is added to indicate reference to the modified form. In this modified form, an annular spring 66′ is positioned between the inner disc 46′ and a wall 67′ of the main body member 11′ and engages such disc at diametrically opposite portions of its periphery. The spring 66′ maintains contact between the periphery of the disc 46′ and the ring 44′ and, also, maintains contact of the periphery of the disc 42′ with the shoulder 41′ on one side and with the ring 44′ on the other side.

There are several advantages obtained from the use of the spring. In some instances, when a spring is not employed, the snap operation of the disc 42′ can cause a bounce-like movement of the disc 46′ which is sufficient to cause a momentary operation of the switch associated with the disc 46′. The spring 66′ supplies sufficient force on the disc 46′ to prevent such bounce. In addition the spring 66′ insures that good heat conducting contact is provided between the disc 42′ and the shoulder 41′ and between both of the discs and the ring 44′. With such structure, optimum sensitivity is obtained with respect to both discs since the good heat conducting flow path is maintained in a reliable manner, even when the thermostat is inverted. In FIG. 3, the disc retaining cup 13′ is open to provide the disc 42′ with radiant heat sensitivity.

It should be understood that although preferred embodiments of the present invention are illustrated, the various aspects of this invention may be applied in other manners. For example, in some instances, it may be desired to form the disc 42 as a one-shot disc while the disc 46 is automatic in operation. In other instances, it may be desired to provide a device in which both discs are automatic in operation. In such an instance, the two associated switches should be constructed to provide the capability of repeated cycling of a magnitude expected to be encountered. Further, with the simplified switch structure illustrated, only two terminals are necessary and the two switches are connected in series. In some instances, it may be desired to provide a completely separate circuitry so additional terminals would be provided to permit nonseries connection of the two switches. In a system in which the disc 42 has relatively great sensitivity to radiant heat, the disc retaining cup is modified to provide an open end.

Although preferred embodiments of this invention are illustrated, it should be understood that various modifications and rearrangements of parts may be resorted to without departing from the scope of the invention disclosed and claimed herein.

What is claimed is:

1. A multiple disc thermostat comprising a body assembly, first and second switches supported on said body assembly, a pair of bimetal snap discs concentrically supported on said body assembly, with one disc operating one switch and the other disc operating the other switch, one of said discs being automatically thermally resettable, the other of said discs being non-automatic and nonresettable in use.

2. A multiple disc thermostat as set forth in claim 1 wherein said discs are substantially equal in size, and a spacer ring is positioned between the peripheries of said discs to engage the peripheries of both discs and maintain a predetermined spacing therebetween, the center portion of said discs moving with snap action response to predetermined temperatures, said switches being operated with snap action in response to the snap movement of the center portions of the associated disc.

3. A multiple disc thermostat as set forth in claim 2 wherein said body assembly includes a shoulder engageable with a periphery of a first of said discs on the side thereof opposite said spacer ring to directly locate said first disc and to locate said second disc through said spacer ring and first disc.

4. A multiple disc thermostat as set forth in claim 3 wherein said second disc is non-automatic and nonresettable in use, and said second disc is located between said first disc and said switches.

5. A multiple disc thermostat as set forth in claim 4 wherein said second disc is formed with a central opening, a first bumper extends through said opening and between said first disc and said one switch, and a second bumper substantially parallel to said first bumper extends between said second disc adjacent to said opening and said other switch.

6. A multiple disc thermostat as set forth in claim 5 wherein said second disc is provided with a greater chord height than said first disc.

7. A multiple disc thermostat as set forth in claim 6 wherein said switches are connected in series, and two external terminals are provided to connect said switches to an external circuit.

8. A multiple disc thermostat as set forth in claim 1 wherein said discs are substantially the same diameter, one of said discs being formed with a central opening, a first bumper extending through said opening and between the other of said discs and one of said switches, and a second bumper substantially parallel to said first bumper extending between said one disc adjacent to said opening and the other of said switches, said one disc being provided with a greater chord height than said other disc.

9. A multiple disc thermostat as set forth in claim 8 wherein said switches are connected in series, and two external terminals are provided to connect said switches to an external circuit.

10. A thermostat comprising a body assembly, first and second switches mounted on said body assembly, said body assembly including retainer means providing a disc support shoulder, a first bimetal snap disc having one side of its periphery positioned against said support shoulder, spacer means positioned against the other side of the periphery of said first disc, a second bimetal snap disc positioned with its periphery against the other side of said spacer means whereby both bimetallic discs are positioned within said body assembly by said support shoulder, both of said discs providing central portions movable snap action response to predetermined calibration temperatures, and operator means operatively connecting said first disc and said first switch for the operation of the latter in response to snap movement of the central portion of said first disc and operatively connecting said second disc and said second switch for operation of the latter in response to snap movement in the central portion of said second disc.

11. A thermostat as set forth in claim 10 wherein said shoulder is provided by a metallic retainer cup, said cup providing a wall substantially perpendicular to said shoulder to laterally positioning both of said discs and said spacer means, and said spacer means is a metallic ring.

12. A thermostat as set forth in claim 11 wherein said spacer ring has opposite flats formed by axially deforming round cross section wire.

13. A thermostat as set forth in claim 12 wherein said second disc provided with a central opening, said operator means includes a first bumper extending through said opening and between said first disc and said first switch, and a second bumper substantially parallel to said first bumper extending between said second disc adjacent to said opening and said second switch.

14. A thermostat as set forth in claim 13 wherein said retainer cup is closed and cooperates with the remainder of said body assembly to completely enclose both of said discs.

15. A thermostat as set forth in claim 13 wherein spring means urge said second disc toward said spacer ring to maintain contact between said discs and said spacer ring and between said first disc and said shoulder.

16. A thermostat as set forth in claim 11 wherein spring means urge said second disc toward said spacer ring to maintain contact between said discs and said spacer ring and between said first disc and said shoulder.

17. A thermostat as set forth in claim 16 wherein said second disc is formed with a central opening, said operator means including a first bumper extending through said opening and between said first disc and said first switch, and a second bumper substantially parallel to said first bumper extending between said second disc adjacent to said opening and said second switch.

18. A thermostat as set forth in claim 17 wherein said first disc is automatically thermally resettable and said second disc is non-automatic.

19. A thermostat as set forth in claim 18 wherein said second disc is non-resettable in use.

20. A thermostat as set forth in claim 19 wherein the chord height of said second disc is greater than the chord height of said first disc.

21. A thermostat as set forth in claim 18 wherein the chord height of said second disc is greater than the chord height of said first disc.

22. A multiple disc thermostat comprising a body assembly, first and second switch means on said body assembly, first and second concentric bimetal snap discs on said body assembly having substantially the same diameter, shoulder means engageable with one side of the periphery of said first disc axially locating said first disc, a metallic spacer ring engageable with the other side of the periphery of said first disc and with one side of the periphery of said second disc to axially locate said second disc with respect to said first disc and in turn with respect to said shoulder means, both of said discs providing central portions movable with snap action in response to predetermined temperatures, said first and second switch means being operated by snap movement of said central portions of said first and second discs, respectively.

23. A multiple disc thermostat as set forth in claim 22 wherein said spacer is flattened and sized in thickness by axially deforming it from its original dimension.

24. A multiple disc thermostat as set forth in claim 23 wherein said spacer ring is deformed from wire having a circular cross-section to have opposed flats engageable with said discs.

25. A multiple disc thermostat as set forth in claim 24 wherein spring means urge said second disc toward said spacer ring to maintain contact between said discs and said spacer ring and between said first disc and said shoulder.

26. A multiple disc thermostat comprising a body assembly, first and second switch means on said body assembly, first and second bimetal snap discs on said body assembly connected to operate said first and second switch means respectively, said switch means each including a terminal and a movable contact support arm connected together and mounted on said body assembly by a rivet or the like, said switch means also each including fixed contact means provided by a single fixed contact element secured in said body assembly, said body assembly having a center line substantially coaxial with said discs, said fixed contact element being stepped to offset said fixed contact means, and each of said movable contact supports extending from its associated terminal across said center line to a fixed contact means on the side of said center line remote from such associated terminal.

27. A multiple disc thermostat comprising a body assembly, first and second switch means on said body assembly, first and second bimetal snap discs on said body assembly connected to operate said first and second switch means respectively, said switch means each including a terminal and a movable contact support arm connected together and mounted on said body assembly by a rivet or the like, said switch means also each including fixed contact means provided by a single fixed contact element secured in said body assembly, wherein said first disc is on the side of said second disc remote from the switch means, said first disc being automatically thermally resettable in use, and said second disc being non-automatic and non-resettable in use.

28. A multiple disc thermostat as set forth in claim 27 wherein said first switch is provided with contacts capable of greater number of cycles of operation than said second switch.

* * * * *